US007845327B2

(12) United States Patent
Tallio et al.

(10) Patent No.: US 7,845,327 B2
(45) Date of Patent: Dec. 7, 2010

(54) HYDRAULIC LASH ADJUSTER WITH DAMPING DEVICE

(75) Inventors: Kevin V. Tallio, Saline, MI (US); Jeff Chester Lyjak, Ann Arbor, MI (US); Floyd Melvin Comer, Carleton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 601 days.

(21) Appl. No.: 11/840,981

(22) Filed: Aug. 19, 2007

(65) Prior Publication Data

US 2009/0044775 A1 Feb. 19, 2009

(51) Int. Cl.
*F01L 1/14* (2006.01)

(52) U.S. Cl. ..... 123/90.52; 123/90.55; 74/569

(58) Field of Classification Search ..... 123/90.45, 123/90.46, 90.48, 90.52, 90.55; 74/567, 74/569

See application file for complete search history.

(56) References Cited

U.S. PATENT DOCUMENTS 3,025,842 A * 3/1962 Slooten ..... 123/90.58
4,393,820 A 7/1983 Maki et al.
4,476,822 A 10/1984 Bonvallet
4,763,616 A 8/1988 Grindsteiner
4,796,573 A 1/1989 Wakeman et al.
4,934,323 A 6/1990 Grindsteiner
5,022,361 A 6/1991 Schut
5,038,726 A 8/1991 Pryba
5,088,458 A 2/1992 Wakeman et al.
5,560,265 A 10/1996 Miller
5,617,818 A 4/1997 Luders
5,622,147 A 4/1997 Edelmayer
5,657,726 A 8/1997 Diggs
5,809,956 A 9/1998 Regueiro
5,862,785 A 1/1999 Blowers et al.
6,047,675 A 4/2000 Kunz
6,273,042 B1 8/2001 Perez et al.
6,484,682 B2 11/2002 Danesh et al.
6,513,472 B2 2/2003 Speil et al.
6,659,056 B2 12/2003 Sweetland
6,920,868 B2 7/2005 Ruggiero et al.
6,953,016 B2 10/2005 Karbstein et al.
6,962,134 B1 11/2005 Douse
7,325,522 B2 * 2/2008 Schmidt ..... 123/90.27
2005/0056242 A1 3/2005 Murata et al.

* cited by examiner

*Primary Examiner*—Ching Chang
(74) *Attorney, Agent, or Firm*—Julia Voutyras; Brooks Kushman P.C.

(57) ABSTRACT

A system and method for lash adjustment in the valvetrain of an internal combustion engine include a hydraulic lash adjuster having a damping device to limit rate of movement of a plunger relative to a body to control response time of the lash adjuster reducing or eliminating over-compensation or pump-up of the lash adjuster.

13 Claims, 4 Drawing Sheets

HYDRAULIC LASH ADJUSTER WITH DAMPING DEVICE

BACKGROUND

1. Technical Field

The present disclosure relates to a hydraulic lash adjuster with a damping device for use in an internal combustion engine valvetrain.

2. Background Art

Modern valvetrain systems use hydraulic lash adjusting elements to compensate for valve train wear, thermal expansion during engine warm-up, and any other phenomena that change clearances within the valve train mechanical linkage. Hydraulic lash adjusters use hydraulic fluid within a variable volume pressure chamber behind a plunger to transmit the valve actuating force from a camshaft to the rocker arm. The volume of fluid within the chamber changes to move the plunger and remove the clearance or lash within the mechanical linkage of the valvetrain. Under some operating conditions or in particularly compliant valvetrains, the lash adjuster may "pump-up" or over compensate by allowing too much hydraulic fluid into the pressure chamber during events where rapid unloading of the mechanical linkage occurs. If the duration of the unloading event is longer than the time required for the lash adjuster to respond and increase the hydraulic fluid volume within the high pressure chamber, the lash adjuster may prevent the valve from closing properly, which could result in undesirable operation or engine damage. Conventional lash adjuster design does not allow for explicit control of the damping characteristics of the adjustment system. Instead, the system response is dictated by the geometry and design of the passage between the high and low pressure chambers within the lash adjuster. While this approach may be suitable for many applications, it may be difficult to tune or adapt the response to a particular valve train system.

SUMMARY

A system and method for adjusting lash in the valvetrain of an internal combustion engine using a hydraulic lash adjuster include a damping device to limit the rate of movement of a lash adjuster plunger relative to the lash adjuster body. Embodiments include a hydraulic lash adjuster having a body with a closed end and an open end for receiving a plunger with the plunger moving in response to a varying quantity of hydraulic fluid within a variable volume high-pressure chamber disposed between the plunger and the body. A damping device associated with at least one of the plunger and the body limits the rate of movement of the plunger relative to the body. A damping element disposed within the high-pressure chamber, or alternatively within a damping chamber, limits flow rate of hydraulic fluid past or through the damping element.

The present disclosure includes embodiments having various advantages. For example, the system and method of the present disclosure incorporate a hydraulic damper into the design of the lash adjuster with either a normally closed, normally open, or free-ball lash adjuster suitable for overhead cam or pushrod engines. Controlling flow passage geometry and/or damper chamber volume facilitates tuning of the lash adjuster response for particular valvetrain designs and/or operating conditions. Response time tuning of the lash adjuster using the damping device may facilitate better control over valve opening and closing events, valve duration, and valve lift. In addition, a tunable response may be used to better match the characteristics of a particular valvetrain design to reduce noise, vibration, and harshness (NVH). The tunable damping feature of the present disclosure may be used to compensate for valve growth during aggressive cold start strategies while providing a more robust control system that is less sensitive to variations in oil temperature and viscosity.

The above advantages and other advantages and features will be readily apparent from the following detailed description of the preferred embodiments when taken in connection with the accompanying drawings.

DETAILED DESCRIPTION OF THE PREFERRED EMBODIMENT(S)

As those of ordinary skill in the art will understand, various features of the embodiments illustrated and described with reference to any one of the Figures may be combined with features illustrated in one or more other Figures to produce alternative embodiments that are not explicitly illustrated or described. The combinations of features illustrated provide representative embodiments for typical applications. However, various combinations and modifications of the features consistent with the teachings of the present disclosure may be desired for particular applications or implementations. The representative embodiments used in the illustrations relate generally to a hydraulic lash adjuster for the valvetrain of a four-stroke, multi-cylinder, internal combustion engine. Those of ordinary skill in the art may recognize similar applications or implementations with other engine/vehicle technologies.

FIGS. 1-5 illustrate operation of a hydraulic lash adjuster for the valvetrain of an internal combustion engine according to representative embodiments of the present disclosure. Multiple cylinder internal combustion engine 10 is generally of conventional design with the exception of the hydraulic lash adjusters. As such, various conventional features associated with the engine and valvetrain are not explicitly illustrated or described. Those of ordinary skill in the art will recognize that the hydraulic lash adjuster of the present disclosure may be used in various types and configurations of engines including but not limited to compression ignition and spark ignition engines arranged in a "V" configuration, a "W" configuration, or an in-line configuration, for example. The representative embodiments illustrated to describe the invention include a cam-in-block or pushrod engine application and an overhead cam, roller finger follower application.

Figure 1:
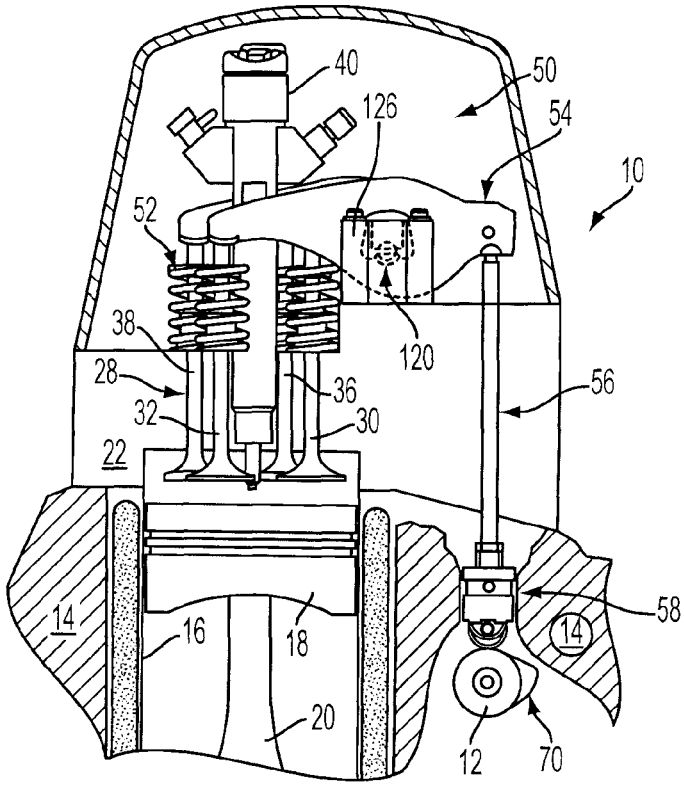
FIG. 1 is a partial cross-section illustrating the valvetrain of an internal combustion engine with a hydraulic lash adjuster having a damping device according to one embodiment of the present disclosure.

Multiple cylinder internal combustion engine 10 includes a camshaft 12 disposed within an engine block 14, and may be referred to as a cam-in-block engine. Each cylinder 16 (only one of which is shown) includes a reciprocating piston 18 coupled by a connecting rod 20 to a crankshaft (not shown). Cylinder head 22 is secured to engine block 14 and provides conventional intake and exhaust passages 15 (FIG. 5) coupled to corresponding ports in cylinder head 22 associated with gas exchange valves 28, which include intake valves 30, 32 and exhaust valves 36, 38. Cylinder head 22 includes conventional hardware such as valve guides, seats, etc. (not shown) associated with operation of gas exchange valves 28. A fuel injector 40 delivers fuel to cylinder 16 in response to a signal provided by an associated engine controller. Although a direct injection engine is illustrated in FIG. 1, the present invention may be used in engines having other fuel injection strategies, such as port injection, for example.

Figure 3:
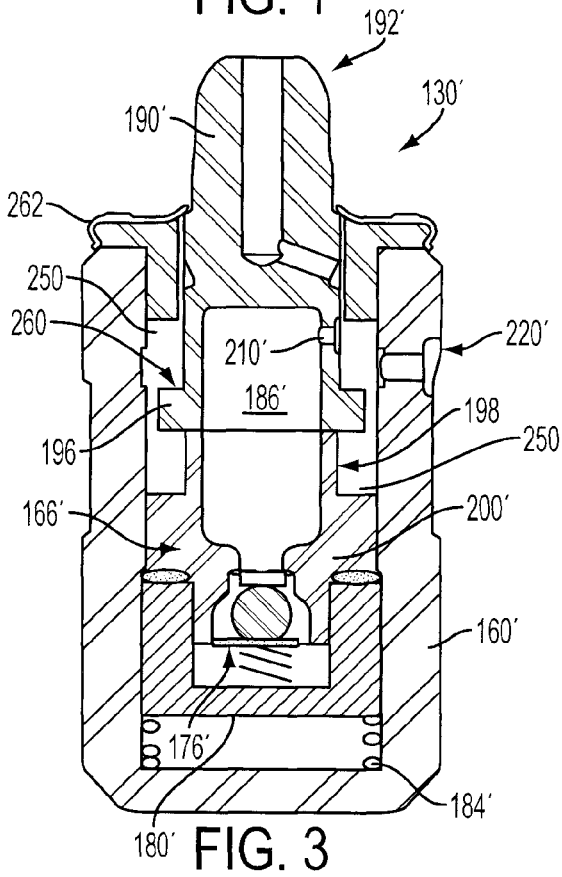
FIG. 3 is a cross-section of a hydraulic lash adjuster having a damping chamber with a damping element extending from the plunger according to one embodiment of the present disclosure.
Figure 2:
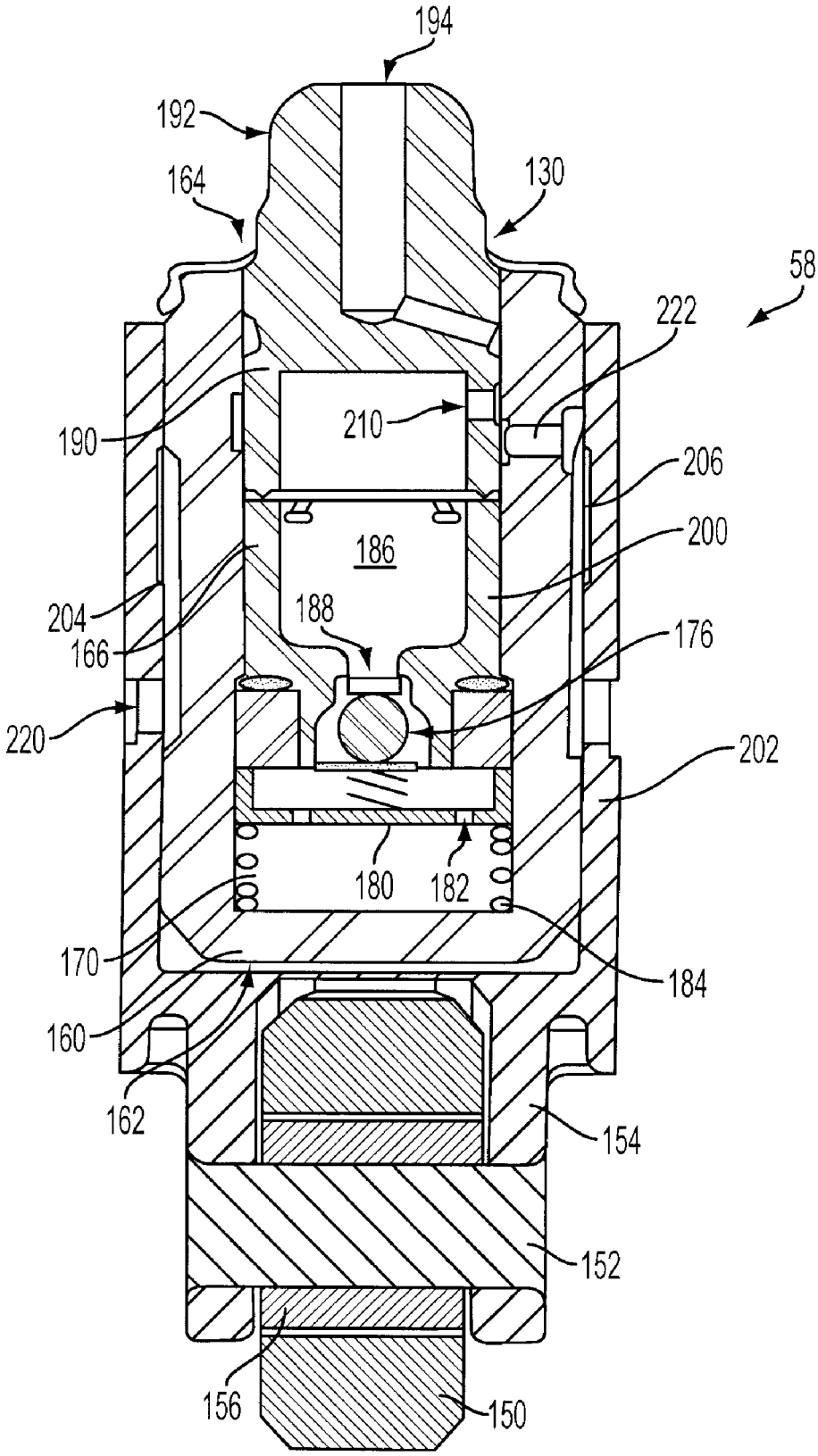
FIG. 2 is a cross-section of a hydraulic lash adjuster with a damping device disposed between a plunger and body according to one embodiment of the present disclosure.
Figure 4:
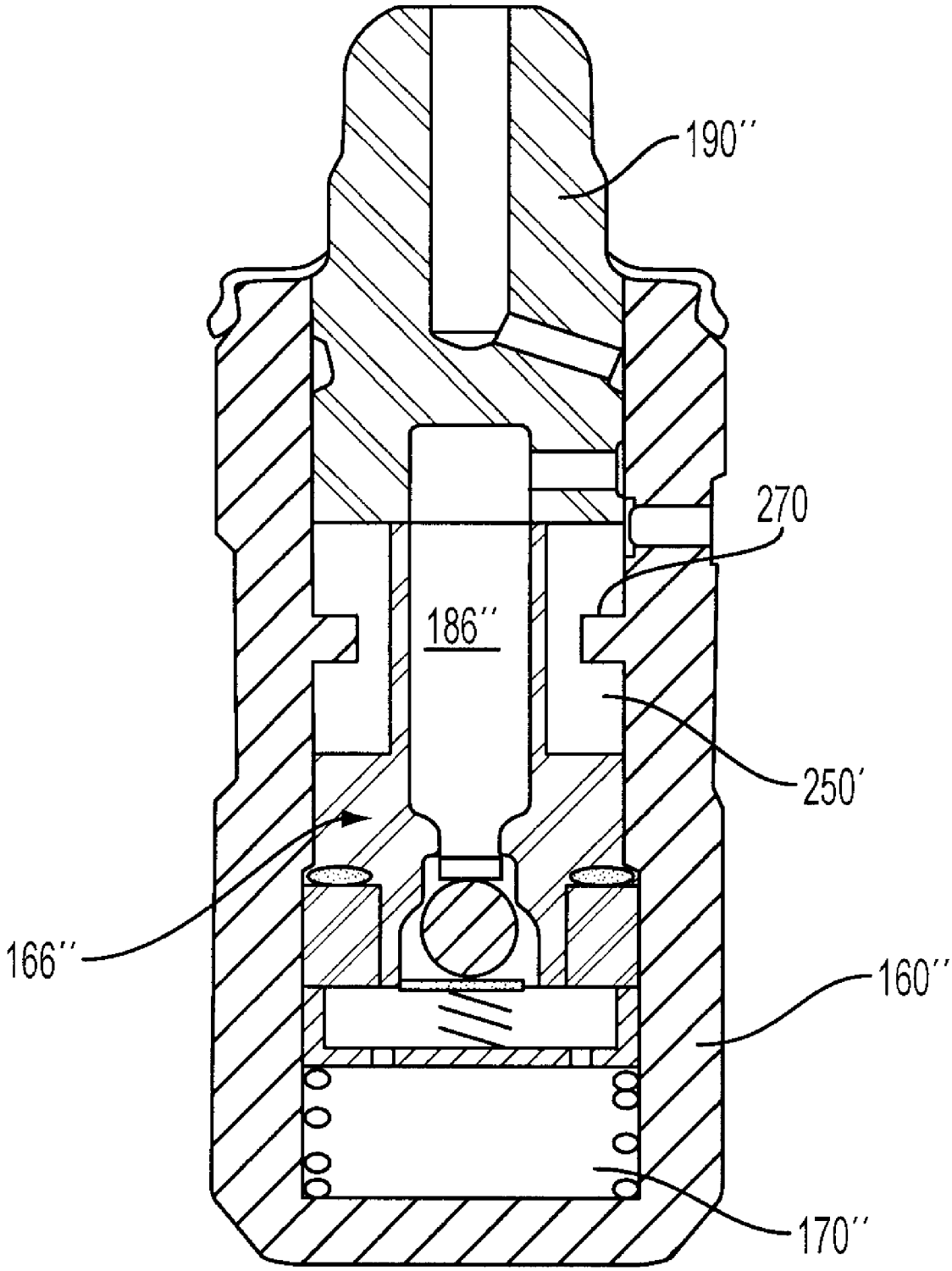
FIG. 4 is a cross-section of a hydraulic lash adjuster having a damping chamber with a damping element extending from the body according to one embodiment of the present disclosure.

Engine 10 includes a valvetrain 50 to control intake of air and/or fuel (for port injected engines) into cylinder 16 and exhaust of combustion gases. Valvetrain 50 includes valves 28, valve springs 52, rocker arms 54, pushrods 56, and lifters 58, sometimes referred to as tappets or cam followers, that include hydraulic lash adjusters with damping features as illustrated in FIGS. 2-4 of the present disclosure. Camshaft 12 includes lobes 70 to actuate valves 28 via cam followers 58 and associated pushrods 56 and rocker arms 54.

In operation, lifter 58 contacts a corresponding lobe 70 of camshaft 12 as camshaft 12 rotates, which raises lifter 58 and an associated lash adjuster to transfer the force to an associated pushrod 56. The pushrod 56 exerts a corresponding force on an associated rocker arm 54, which pivots about an integral ball/socket pivot point 120 with the ball supported by an associated fulcrum 126 secured to cylinder head 22. Rocker arms 54 translate the generally upward motion from pushrods 56 to a generally downward motion to move intake valves 30, 32 against associated springs 52 to open the intake ports. As camshaft 12 continues rotating, lifter 58 follows the profile of lobe 70 and begins a generally downward motion so that the associated springs 52 close intake valves 30, 32. Actuation of exhaust valves 36, 38 proceeds in a similar manner.

As illustrated and described with reference to FIGS. 2-4, each cam follower or lifter 58 preferably includes a hydraulic lash adjuster having a damping device to adjust lash associated with each pushrod and rocker arm to compensate for thermal growth, wear, and the like. Lifter 58 of FIG. 2 is a cam follower or tappet that includes a roller 150 mounted for rotation about an axle 152 secured to housing 154. A bearing 156 or similar device facilitates rotation of roller 150 about axle 152 when in contact with a corresponding camshaft lobe. Housing 154 includes an axial bore with a lash adjuster 130 disposed therein. Lash adjuster 130 includes a body 160 secured within the axial bore of housing 154 and having a closed end 162 and an open end 164 for receiving a movable plunger 166. A variable volume high-pressure chamber 170 is defined by the space between the closed end 162 of body 160 and the bottom of plunger 166. A check valve 176 controls flow of hydraulic fluid from low pressure chamber or reservoir 186 disposed within plunger 166 through a high-pressure port 188 into high-pressure chamber 170. Although check valve 176 is illustrated as a normally-closed ball and spring type valve, a normally-open configuration may be desirable for some applications. Similarly, various other types of check valves may be used to control flow direction of hydraulic fluid.

In the embodiment of FIG. 2, lash adjuster 130 includes a damping device implemented by a damping member 180 disposed within high-pressure chamber 170. Damping member 180 functions as a separator that divides high-pressure chamber 170 into first and second regions and includes at least one orifice 182 sized to control or limit flow rate of hydraulic fluid between the first and second regions of high-pressure chamber 170. A spring 184 is disposed within high-pressure chamber 170 between body 160 and damping element or separator 182. Spring 184 operates on damping element 180 and plunger 166 to apply a sufficient force to extend the lash adjuster and eliminate the lash in the system. As spring 184 extends, oil flows into high-pressure chamber 170 to support the valvetrain system with the lash adjuster at the appropriate height.

In the representative embodiments illustrated in FIGS. 2-4, plunger 166 is implemented by an upper plunger member 190 having an upper end 192 adapted for coupling to a push rod. Upper end 192 may also include a lubrication channel 194 for delivering engine oil through the push rod to the upper components of the valvetrain. Upper end 192 may alternatively be generally concave for coupling to a ball-end push rod. Plunger 166 includes a lower plunger member 200 disposed in body 160 in contact with upper plunger member 190.

Housing 154 includes one or more supply ports 220 that supply hydraulic fluid/engine oil to the outside of body 160, which in turn includes one or more supply ports 222 to deliver oil to the interior of body 160 and lubrication channel 194. Similarly, plunger 160 includes at least one low-pressure port to deliver hydraulic fluid to low pressure chamber 186 from the interior of body 160.

In operation, lash adjusters essentially eliminate any lash or clearance between the valve train components under varying operating and ambient conditions to provide consistent and reliable valve actuations, including repeatable valve opening and closing times and peak lift values. For hydraulic lash adjusters according to the present disclosure, as the length of the valvetrain components varies due to temperature or wear, hydraulic fluid from a pressurized supply enters lifter 58 through transverse bore 220 in housing 154 and enters low pressure chamber 186. A small amount of hydraulic fluid passes through check valve 176 into variable-volume high-pressure chamber 170 to support the plunger in a position to remove any lash or clearance between corresponding pushrods and rocker arms. As such, the force generated by the cam lobe rotating in contact with roller 150 is transferred through housing 154 to lash adjuster body 160 through the hydraulic fluid trapped within high-pressure chamber 170 by check valve 176 to plunger 166. If the valvetrain components increase in length due to thermal expansion, hydraulic fluid escapes very slowly from high-pressure chamber 170 through a "leak-down" path formed by clearance between plunger 166 and body 160 to reduce the volume contained within high-pressure chamber 170.

Some conventional hydraulic lash adjusters that do not include a damping device as described in the present disclosure may be prone to "pump-up" or over compensate due to rapid unloading of the valvetrain mechanical linkage. If the duration of an unloading event is longer than the response time of the lash adjuster, additional (undesirable) hydraulic fluid enters the high-pressure chamber 170 and does not escape quickly enough through the leak-down path such that the lash adjuster may extend sufficiently to hold the valve off of the valve seat resulting in adverse engine operation that could lead to a misfire of one or more cylinders and/or result in permanent damage to the engine. The response time of conventional hydraulic lash adjusters is a function of inherent damping that is controlled by the geometry and design of the passage between the high and low pressure chambers. However, this passage is subject to additional constraints and can not be readily tuned to adapt to a specific valvetrain system design.

According to the present disclosure, a damping device is provided to reduce or eliminate "pump-up" for normally-open and normally-closed lash adjusters. In the embodiment of FIG. 2, damping element 184 includes orifices 182 to limit the rate of flow of hydraulic fluid in high pressure chamber 170. By controlling the volume in the first and second regions of high-pressure chamber 170, as well as the size and number of orifices 182, damping element 180 limits the rate of fluid flowing into high-pressure chamber 170, which limits the rate of movement of plunger 166 relative to body 160 to reduce or eliminate pump-up. Alternatively, or in combination, high pressure port 188 may be sized to tune the response of the lash adjuster to reduce or eliminate the occurrence of pump-up or overcompensation.

FIGS. 3 and 4 illustrate alternative embodiments of a hydraulic lash adjuster having a damping device according to the present disclosure. The embodiments of FIGS. 3 and 4 operate in a similar fashion as the lash adjuster described with reference to FIG. 2 with primed reference (130', 130" etc.) numerals indicated components or features having a similar or identical structure and function to the corresponding feature described using unprimed reference numerals with differences as noted.

As shown in FIG. 3, lash adjuster 130' includes a damping device implemented by a circumferential damping chamber 250 and at least one flow restricting element 260 extending into damping chamber 250. Damping chamber 250 is formed between a middle portion of plunger 166' and body 160' and is filled with hydraulic fluid entering port 220'. Damping chamber 250 also supplies low pressure chamber 186' with hydraulic fluid through low-pressure supply port 210'. Flow restricting element 260 extends from plunger 166' into damping chamber 250 to control flow rate of hydraulic fluid as plunger 166' moves within body 160'. Flow restricting element 260 may be integrally formed of a unitary construction with plunger 166' and extend from upper plunger member 190' and/or lower plunger member 200' depending on the particular application and implementation. Similarly, flow restricting element 260 may be implemented by a discrete element secured for movement with plunger 166', such as a snap ring, for example. It should also be noted that ports 210' and 220' could be located either above or below flow restricting element 260.

As also illustrated in FIG. 3, upper plunger member 190' includes an upper end 192' adapted for coupling to a corresponding valvetrain component, such as a follower arm or pushrod, and a lower end with a flange 196 extending into damping chamber 250. Lower plunger member 200' includes an upper end 198 having a reduced outer diameter relative to the outer diameter of flange 196 to form damping chamber 250. Similarly, upper plunger member 190' includes a reduced diameter portion above flange 196. A cap 262 with a seal is secured within body 160' to limit the rate of hydraulic fluid exiting adjuster 130' via the leak-down path formed by the clearance between plunger 166' and body 160'.

In operation, during a valvetrain unloading event, hydraulic fluid within damping chamber 250 must be displaced from above flange 196 to below flange 196, and/or must exit chamber 250 through the leak-down path for plunger 166' to move within body 160'. As such, flange 196 operates as a flow restricting damping element limiting the rate of movement of plunger 166' within body 160'. Similarly, cap 262 may also operate as a flow restricting element that radially overlaps flange 196 to restrict or limit flow rate of hydraulic fluid so that lash adjuster 130' does not over compensate or pump-up in response to a valvetrain unloading event. The time constant or response time of lash adjuster 130' can be tuned for a particular application using the volume of damping chamber 250 in combination with the size of the damping element implemented by flange 196, and/or the overlapping area of two or more damping elements to restrict flow of hydraulic fluid. In addition, holes 210' and 220' are appropriately sized to deliver the desired damping response.

Referring now to FIG. 4, hydraulic lash adjuster 170" includes a damping device implemented by a damping chamber 250' disposed between a middle portion of plunger 166" and body 160" and a damping element 270 extending within damping chamber 250' to limit the movement rate of plunger 166" within body 160". Damping element 270 extends into damping chamber 250' from body 160" and may be integrally formed of a unitary construction as illustrated. Alternatively, damping element 270 may be a discrete component secured to body 160" and extending within damping chamber 250'. For example, damping element 270 may be implemented by a snap ring secured within a interior groove in body 160" and extending into damping chamber 250'. Features of the embodiments illustrated in FIGS. 3 and 4 may be combined in a lash adjuster having a damping chamber with one or more damping elements extending from the body into the damping chamber in addition to one or more damping elements extending from the plunger into the chamber. Damping elements may radially overlap to restrict flow while being axially or longitudinally spaced from one another so they do not come into contact during operation.

Figure 5:
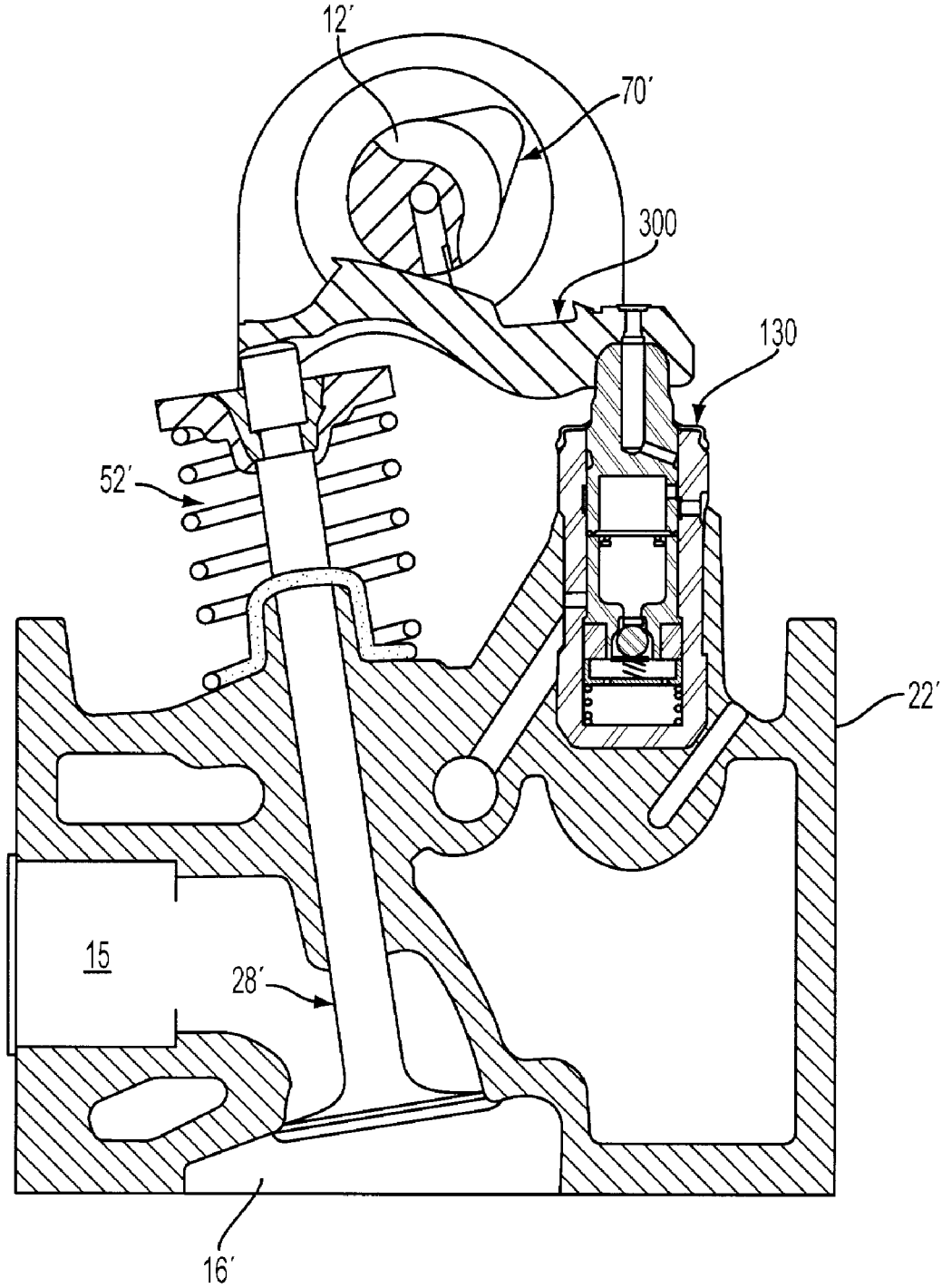
FIG. 5 is a cross-section illustrating a hydraulic lash adjuster according to the present disclosure in an overhead cam, roller finger follower valvetrain application.

FIG. 5 illustrates a hydraulic lash adjuster with a damping device in an overhead cam, roller finger follower valvetrain according to one embodiment of the present disclosure. Camshaft 12' includes a plurality of lobes 70' that contact roller finger follower 300 to actuate a corresponding gas exchange valve 28'. Lash adjuster 130 is positioned in cylinder head 22' and operates to remove lash associated with thermal growth and/or wear of valvetrain components, such as valve 28', roller finger follower 300, valve spring 52', and camshaft 12'. Lash adjuster 130 operates as described above with reference to FIG. 2. Of course, various other embodiments of lash adjuster 130 incorporating one or more damping devices according to the present disclosure, such as the embodiment illustrated in FIG. 3, for example, may also be used in overhead cam applications for various engine configurations as previously described.

As such, the system and method of the present disclosure for adjusting lash in the valvetrain of an internal combustion engine incorporate a hydraulic damper into the design of the lash adjuster to provide a normally open or normally closed lash adjuster. Controlling flow passage geometry and/or damper chamber volume facilitates tuning of the lash adjuster response for particular valvetrain designs and/or operating conditions. Response time tuning of the lash adjuster using the damping device may facilitate better control over valve opening and closing events, valve duration, and valve lift. In addition, a tunable response may be used to better match the characteristics of a particular valvetrain design to manage noise, vibration, and harshness (NVH). The tunable damping feature of the present disclosure may be used to compensate for valve growth during aggressive cold start strategies while providing a more robust control system that is less sensitive to variations in oil temperature and viscosity.

While the best mode has been described in detail, those familiar with the art will recognize various alternative designs and embodiments within the scope of the following claims. One or more embodiments have been described as providing advantages or being preferred over other embodiments or conventional devices in regard to one or more desired characteristics. However, as one skilled in the art is aware, different characteristics may provide advantages and be preferred in some applications while being considered less desirable or disadvantageous in other applications. These attributes include, but are not limited to: cost, strength, durability, life cycle cost, marketability, appearance, packaging, size, serviceability, weight, manufacturability, ease of assembly, etc. As such, any embodiment described as being preferred or advantageous with respect to one or more characteristics does not preclude embodiments or implementations that may be less desirable or less advantageous but are also within the scope of the disclosure and claims.

What is claimed is:

1. A hydraulic lash adjuster having a damping device to limit rate of movement of a plunger relative to an associated body, comprising:

a circumferential damping chamber formed between a middle portion of the plunger and the body; and at least one flow restricting element extending into the damping chamber from the body and/or the plunger to control flow rate of hydraulic fluid within the damping chamber as the plunger moves within the body.

2. The hydraulic lash adjuster of claim 1 wherein the flow restricting element is integrally formed within the body.

3. The hydraulic lash adjuster of claim 1 wherein the flow restricting element comprises a snap ring partially positioned within a groove within the body.

4. The hydraulic lash adjuster of claim 1 wherein the flow restricting element is integrally formed with the plunger.

5. A hydraulic lash adjuster for the valvetrain of an internal combustion engine, the lash adjuster comprising:

a body having a closed end and an open end;

a plunger disposed within the body and defining a variable volume high-pressure chamber between the plunger and the closed end of the body, the plunger having a low-pressure chamber disposed therein with a low-pressure port in communication with a supply port in the body and a high-pressure port selectively coupled to the high-pressure chamber;

a check valve disposed between the low-pressure chamber and the high-pressure chamber; and a damping chamber formed between the plunger and the body; and a first damping element extending from the body into the damping chamber and a second damping element extending from the plunger into the damping chamber to limit movement rate of the plunger within the body.

6. The hydraulic lash adjuster of claim 5 wherein the damping device comprises a damping element disposed within the high-pressure chamber and having at least one orifice to restrict flow of hydraulic fluid in the high-pressure chamber.

7. The hydraulic lash adjuster of claim 6 further comprising:

a biasing spring disposed between the damping element and the body, wherein the check valve includes a ball biased by a spring disposed above the damping element to limit control direction of hydraulic fluid flow into the high-pressure chamber.

8. The hydraulic lash adjuster of claim 7 wherein the at least one damping element extends from the body into the damping chamber.

9. The hydraulic lash adjuster of claim 5 wherein the first and second damping elements include an overlapping portion.

10. The hydraulic lash adjuster of claim 5 wherein the damping chamber surrounds a middle portion of the plunger and wherein the plunger comprises:

an upper plunger member having an upper end adapted for coupling to a push rod and a lower end with a flange extending into the damping chamber; and a lower plunger member disposed in the body below the upper plunger member and having an upper end with a reduced outer diameter relative to the outer diameter of the flange.

11. A comprising:

adjusting lash in the valvetrain of an engine using a hydraulic lash adjuster; and limiting the rate of movement of a plunger relative to a body of the hydraulic lash adjuster using a damping chamber formed between an outside diameter of the plunger and inside diameter of the body and positioning a damping element associated with at least one of the body and the plunger within the damping chamber.

12. The method of claim 11 wherein the damping device includes a damping element disposed within a high-pressure chamber between the plunger and the body and wherein the step of limiting the rate of movement comprises limiting flow rate of hydraulic fluid through at least one orifice in the damping element.

13. The method of claim 11 wherein the step of limiting the rate of movement comprises radially overlapping a first damping element associated with the plunger with a damping element associated with the body, the first and second damping elements being axially spaced to prevent contacting one another during operation.

* * * * *